United States Patent [19]

Suttles

[11] 4,303,162

[45] Dec. 1, 1981

[54] FORWARD FEED MERCHANDISING DEVICE FOR SOFT DRINK BOTTLES

[75] Inventor: James M. Suttles, Elberton, Ga.

[73] Assignee: The Mead Corporation, Atlanta, Ga.

[21] Appl. No.: 65,931

[22] Filed: Aug. 13, 1979

[51] Int. Cl.[3] ..... A47F 1/00

[52] U.S. Cl. ..... 211/49 D

[58] Field of Search ..... 211/49 D; 221/253; 312/45, 91

[56] References Cited

U.S. PATENT DOCUMENTS

| | | | |
|---|---|---|---|
| 2,110,299 | 3/1938 | Hinkle | 211/49 D |
| 2,218,444 | 10/1940 | Vineyard | 211/49 D |
| 2,738,881 | 3/1956 | Michel | 211/49 D |
| 2,806,631 | 9/1957 | Van Vactor | 211/13 |
| 2,934,212 | 4/1960 | Jacobson | 211/49 D |
| 3,083,067 | 3/1963 | Vos et al. | 312/71 |
| 3,161,295 | 12/1964 | Chesley | 211/49 D |
| 3,166,195 | 1/1965 | Taber | 211/49 D |
| 3,308,961 | 3/1967 | Chesley | 211/49 D |
| 3,848,745 | 11/1974 | Smith | 211/49 D |
| 4,128,177 | 12/1978 | Bustos | 211/49 D |

FOREIGN PATENT DOCUMENTS

| | | | |
|---|---|---|---|
| 106617 | 11/1963 | Netherlands | 211/49 D |

*Primary Examiner*—Roy D. Frazier
*Assistant Examiner*—Robert W. Gibson, Jr.
*Attorney, Agent, or Firm*—Howson and Howson

[57] ABSTRACT

A spring-driven track unit for merchandising soft drink bottles has a sliding sheet metal pusher having a forwardly extending foot and a sloping back extending upwardly and forwardly from the rear edge of the foot. A self-coiling polyester sheet extends from a coil retained at the front of the track, along the supporting surface of the track and underneath the pusher foot. The self-coiling sheet is secured to the back of the pusher and provides a bearing surface for a driving spring which is in the form of a narrow, self-coiling strip. The driving spring is secured to the track near the front end and extends rearwardly in a recess to a coil located behind the sloping back of the pusher. The force of the pusher on the bottles is adjustable by bending the sloping back upwardly or downwardly. The pusher is prevented from sliding off the track by tabs bent downwardly from inwardly extending flanges below and integral with the track.

10 Claims, 8 Drawing Figures

FORWARD FEED MERCHANDISING DEVICE FOR SOFT DRINK BOTTLES

BRIEF SUMMARY OF THE INVENTION

This invention relates to merchandising supports for dispensing special articles from a stack. It relates particularly to a merchandising apparatus having the capability of supporting a plurality of upstanding bottles, such as soft drink bottles, arranged in a generally horizontal column and automatically feeding the bottles in the column forward in a columnwise direction when the foremost bottle in the column is removed by a customer.

Numerous forward feed devices have been proposed for use in merchandising products of various types, including bottled slot drinks. These devices fall in three general categories. The first category comprises inclined track devices relying on gravity to feed the articles in a forward direction. An example of an inclined track device is found in U.S. Pat. No. 2,218,444 to G. S. Vineyard, dated Oct. 15, 1940. The second category comprises devices using conveyor belts having sloping conveyor surfaces and utilizing gravity acting on the articles carried by the conveyor to effect forward movement of the articles. An example of the device in the second category is found in the copending U.S. patent application of John L. Williams and Asa V. Brown, Jr., filed on Apr. 4, 1979 under Ser. No. 26,957 now U.S. Pat. No. 4,239,099, issued Dec. 16, 1980. The conveyor belt in the Williams and Brown application is used to overcome one of the major problems inherent in gravity-feed devices in the first category, namely the inability of such devices to accommodate bottles having different frictional characteristics. In a gravity-feed device in the first category, glass bottles will tend to slide at a much faster rate than plastic bottles on a track having a given inclination because of their different frictional characteristics. By using a conveyor belt in a gravity-feed device, different types of bottles can be made to behave in a similar manner since the friction between the conveyor belt and its underlying support is not affected by the material from the bottles are made.

The third category comprises devices which rely upon springs to effect feeding of articles in a forward direction. Examples of devices of the third category are found in the following U.S. Pat. Nos.: Michel 2,738,881, Mar. 20, 1956; Van Vactor 2,806,631, Sept. 17, 1957; Jacobson 2,934,212, Apr. 26, 1960; Vos et al. 3,083,067, Mar. 26, 1963; Chesley 3,161,295, Dec. 15, 1964; Taber 3,166,195, Jan. 19, 1965; Chesley 3,308,961, Mar. 14, 1967; and Smith 3,848,745, Nov. 19, 1974. Despite the existence of these, and many other patents relating to spring-driven forward feed merchandising devices, no spring-driven device has ever gone into widespread use in the merchandising of bottled products such as soft drinks. It is believed that there still exists a need for a spring-driven forward feed merchandising device for handling bottled products which is capable of smooth and reliable operation, but which is nevertheless sufficiently low in cost and complexity to be practical. It is therefore a general object of the invention to provide a forward feed merchandising device for soft drink bottles which is simple in construction, capable of being manufactured at a low cost, and smooth and reliable in its operation. It is also an object of the invention to provide a spring-driven forward feed merchandising device having minimum space requirements. Still another object of the invention is to provide a simple and effective means for controlling the force exerted by a driving spring on a column of bottles so that adjustments can readily be made when required.

The apparatus in accordance with the invention comprises the following basic elements together with various other elements and features: means providing a substantially rigid supporting surface for supporting a column of bottles; means for guiding bottles supported by the supporting surface for movement in a columnwise direction parallel to said surface; pusher means for engaging the rearmost bottle in the column; guide means constraining the pusher means for movement in a columnwise direction; means for stopping the movement of the column when the foremost bottle reaches a predetermined position relative to the supporting surface; and spring means urging the pusher means in a forward columnwise direction.

In the preferred embodiment of the invention, the spring means comprises a self-coiling strip of spring material secured at one end to the rigid supporting surface near the forward end thereof, extending rearwardly to a location behind the pusher, and being coiled at said location. The coil is arranged to exert a forwardly directed force on the rear side of the pusher, the force being sufficient, in any position within the range of movement of the pusher, to move all of the bottles in a forward columnwise direction until the foremost bottle reaches the predetermined position at which the entire column is stopped by the stopping means. A length of flexible sheet material is secured to the pusher means and extends forwardly therefrom along the supporting surface. This sheet is positioned underneath the bottles and between the bottles and the supporting surface. It serves substantially to eliminate variations in the coefficient of friction between the bottles and the supporting surface by preventing direct contact between the bottles and the supporting surface. The flexible sheet material extends over the rear side of the pusher and between the rear side of the pusher and the coil of the spring, whereby the flexible sheet material also serves as a bearing surface for the coil to promote smooth operation of the device.

The pusher means preferably comprises a unitary sheet metal member having a first section located above and adjacent the supporting surface and extending in parallel relation thereto. This first section cooperates with the supporting surface to prevent tilting of the pusher and has both a front edge and a rear edge. The pusher means also comprises a second section extending upwardly and forwardly from the rear edge of the first section. This second section has an upper edge, and a third section extends upwardly from the upper edge. The third section is adapted to engage the rearmost bottle in the column. This pusher configuration has the advantage that it takes up little space in the longitudinal direction, thus allowing more space for the storage of bottles. Preferably, the coil of the spring is located behind the sloping second section of the pusher, and thus takes up little additional longitudinal space.

The angle between the oblique rearwardly facing surface of the pusher means and the columnwise direction is preferably made adjustable, for example, by bending the pusher. The coil of the spring exerts a perpendicular force on the oblique rearwardly facing surface of the pusher means. The force exerted by the spring in a direction perpendicular to the rearward face of the pusher means can be resolved into a first component which is in the columnwise direction, and a second component which is perpendicular to the columnwise direction. The magnitude of the columnwise component of force can be adjusted by adjusting the angle of the oblique rearwardly facing surface of the pusher. Thus, if a spring proves to be either too weak or too strong for a given set of conditions (types of bottles, slope of track, etc.) the pushing force can be readily adjusted.

In the preferred embodiment of the invention, the rigid supporting surface is provided with a recess extending rearwardly from the location at which the self-coiling strip is secured to the supporting surface at least to the rearmost location of the pusher means within its range of movement. The pusher means includes means for maintaining the portion of the self-coiling strip which extends between the pusher means and the location at which it is secured to the supporting surface within the recess. Thus, the portion of the self-coiling strip forward of the pusher means is located within the recess and underneath the flexible sheet, and does not interfere with the movement of the bottles in the column. Desirably, the forward end of the self-coiling strip extends downwardly through a transverse slot in the recess of the supporting surface, with its forward end located underneath the supporting surface and forward of the slot. The strip has a through hole at the location of the slot, and the rear edge of the slot has a projection extending through the hole, thereby securing the strip in the slot. When the self-coiling strip is attached to the supporting surface in this manner, the forward end of the strip cannot coil up and interfere with the movement of the bottles.

The means providing a substantially rigid supporting surface is preferably an elongated sheet metal element having an elongated web and a pair of reinforcing flanges located along its opposite long edges and extending downwardly therefrom. Each reinforcing flange has an integral inwardly extending flange at its lower edge. The pusher means preferably comprises a sheet metal member having a first section extending across the web of the supporting surface in closely spaced parallel relation thereto, a pair of integral depending flanges extending downwardly from the first section, each in closely spaced parallel relation to one of the reinforcing flanges of the supporting surface, and a pair of inwardly extending flanges, each being integral with one of the depending flanges. Each of the inwardly extending flanges of the pusher means is arranged below and in closely spaced relation to an inwardly extending flange of the supporting surface. Thus, the flanges serve as the guide means for constraining the pusher means for movement in the columnwise direction. Each of the inwardly extending flanges of the supporting surface is provided with a pair of longitudinally spaced slots extending outwardly from its innermost edge. These slots form tabs which are located opposite each other near the forward end of the supporting surface. The tabs are bent downwardly to positions such that they are engageable by the inwardly extending flanges of the pusher means to limit forward movement of the pusher means. Individual spring tracks for insertion in a display rack can be readily assembled by attaching the spring means to the support, sliding the pusher means onto the support, and bending the tabs downwardly to prevent removal of the pusher means from the support. The tabs thus provide an extremely simple yet effective expedient for the assembly of spring track units.

The length of flexible sheet material is preferably a self-coiling sheet, and means are provided adjacent the forward end of the supporting surface in the apparatus for retaining the coiled end of the self-coiling sheet at a substantially fixed location while allowing the sheet to coil as the pusher means moves forward. The self-coiling sheet, however, is not relied upon to effect movement of the column of bottles. Rather, the spring means is designed to exert a sufficient force in any position within its range of movement to move all of the bottles in a forward columnwise direction until the foremost bottle reaches the predetermined position at which the stopping means effects stopping of the column. By using a self-coiling sheet for reducing the effects of firction variation, and at the same time relying upon a spring means to effect forward movement of the bottles, a forward feed of bottles is accomplished with a degree of smoothness and reliability not heretofore achieved.

Various objects and advantages of the invention in addition to those outlined above will be apparent from the following detailed description when read in conjunction with the drawings.

DETAILED DESCRIPTION

Figure 1:
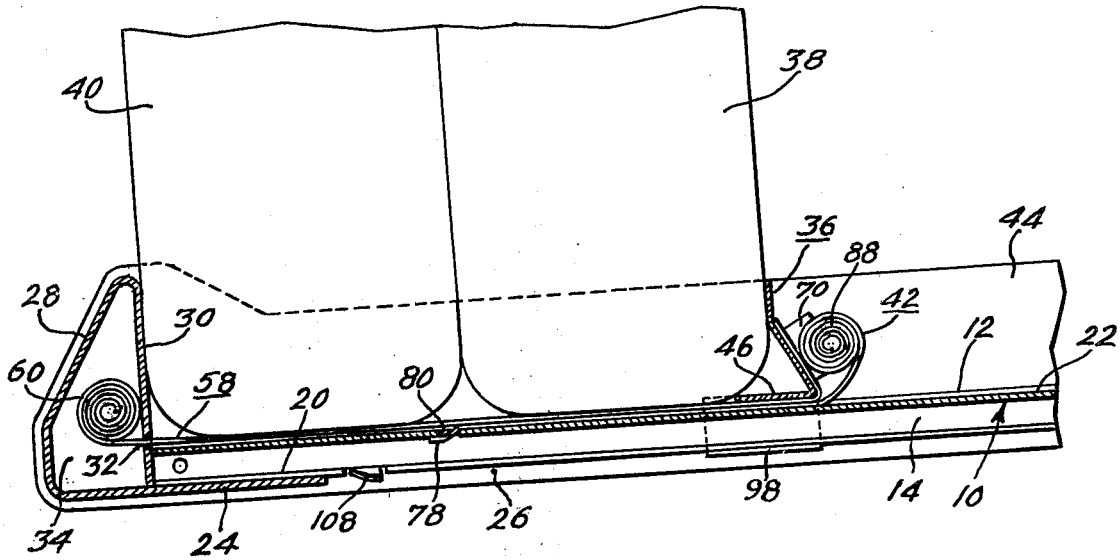
FIG. 1 is a vertical section taken in the longitudinal direction through a forward feed merchandising device in accordance with the invention.
Figure 2:
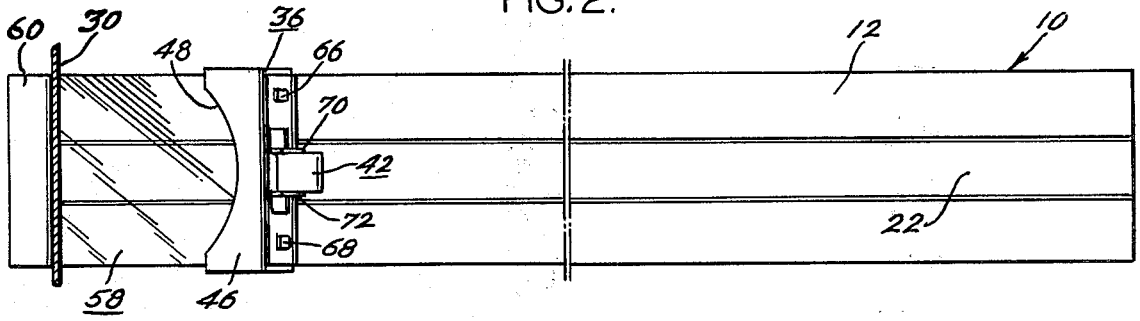
FIG. 2 is a top plan view of the forward feed device.
Figure 6:
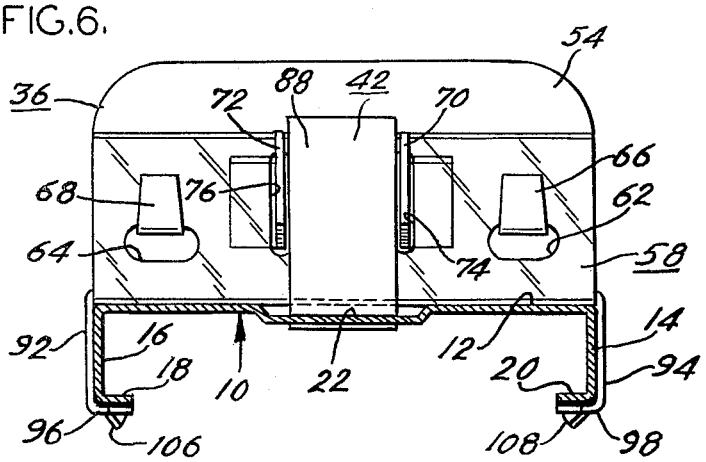
FIG. 6 is a section taken on the plane 6—6 of FIG. 4.

A sheet metal track 10, as shown in FIGS. 1 and 6, comprises a generally rectangular, elongated web 12 having integrally formed flanges 14 and 16 depending from its opposite long edges, and inwardly extending flanges 18 and 20 integrally formed at the lower edge of depending flanges 16 and 14 respectively. Web 12 provides a substantially rigid supporting surface capable of supporting a column of bottles. Depending flanges 14 and 16 serve as reinforcements for the track and contribute to the rigidity of the supporting surface. As shown in FIG. 6, a recess 22 is provided in web 12. This recess preferably extends from one end of the track to the other. Its purpose is to provide a space for a self-coiling spring strip which drives the pusher in a forward direction on the track. The remaining parts of the web, however, provide what is essentially a flat supporting surface.

Track 10 is removably supported on a shelf (along with a number of other tracks not shown). The shelf, as seen in FIG. 1, comprises a bottom element 24 on which the forward end of track 10 rests, and a similar bottom element (not shown) is provided at the rear of the shelf. Between these bottom elements is an opening 26. This opening extends through the full range of movement of the pusher element on the track so that there is no interference by the track supports with the movement of the pusher.

The shelf supports the tracks so that their bottle supporting surfaces are generally horizontal. The supporting surfaces need not be exactly horizontal, however, and it may be desirable in some instances to arrange the tracks so that they slope downwardly and forwardly (for example at an angle of 3½ degrees) in order to facilitate removal of bottles where shelves are stacked vertically on a support.

Front wall 28 of the shelf is bent to provide a downwardly extending wall portion 30 which, when engaged by the foremost bottle in a column, serves to stop the movement of the column. A slot 32 is provided in element 30 just above the level of the supporting surface of web 12 to allow passage of a flexible sheet into an enclosure 34 formed at the front wall of the shelf.

A pusher, generally indicated at 36, extends upwardly from track 10 in a generally vertical direction and is longitudinally slidable on the track. The pusher is adapted to engage the rearmost bottle in a column of bottles, and to push all of the bottles in the forward direction. In FIG. 1, pusher 36 is shown in engagement with bottle 38, which is the rearmost bottle in a two-bottle column comprising bottles 38 and 40. The foremost bottle 40 is shown in engagement with front wall element 30.

Pusher 36 is urged in the forward direction (toward the front wall of the shelf) by a spring means 42. The spring means is preferably a self-coiling strip, as indicated in FIG. 1. The spring should exert sufficient force throughout the range of movement of the pusher means to move all of the bottles between the pusher means and wall element 30 until the foremost bottle reaches wall element 30 in the position of bottle 40 in FIG. 1. In a typical forward feed device, a full column will contain four or five bottles. Assuming that the shelf, when full contains columns of five bottles, the spring means should exert a sufficient force to move the four remaining bottles when the foremost bottle is removed, to move the remaining three bottles when the next bottle is removed, and so on. A positive gradient spring is preferred for this purpose since it is important to exert sufficient force to move four or five bottles when the spring is fully extended, and yet not exert excessive force on the smaller numbers of bottles present when the spring is partially retracted.

The bottles are maintained in a column by suitable guides. A side wall 44 of the shelf serves as one of the guides for the bottles in FIG. 1. On the opposite side of track 10, a rod (not shown) or similar guiding device is provided at a height such that the bottles are maintained by it in a columnar arrangement.

Figure 5:
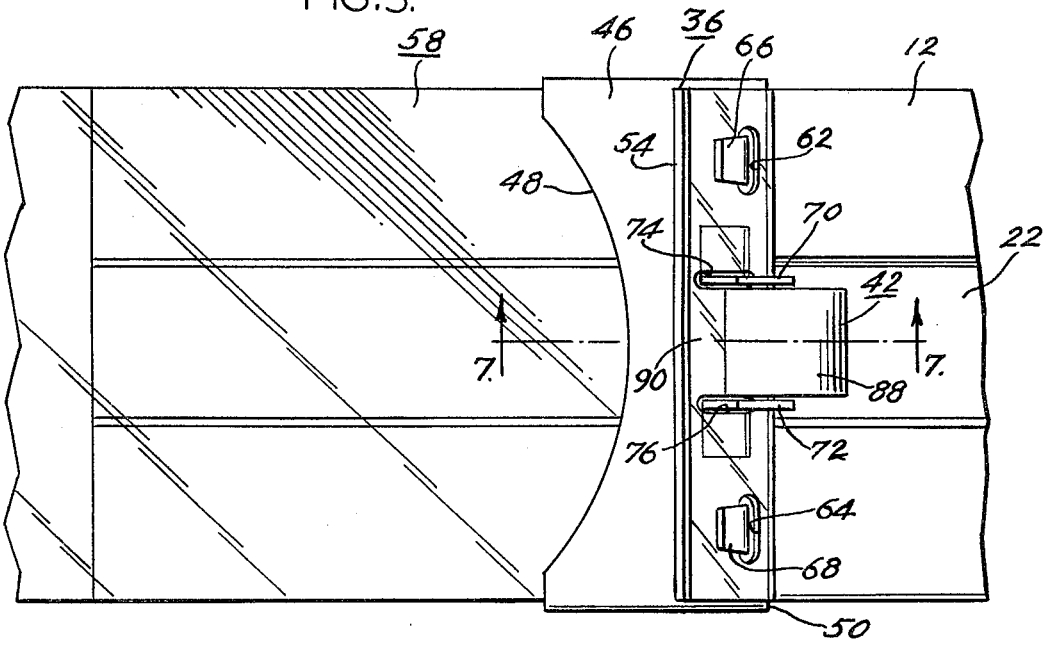
FIG. 5 is a fragmentary top plan view also showing the details of the pusher means.
Figure 7:
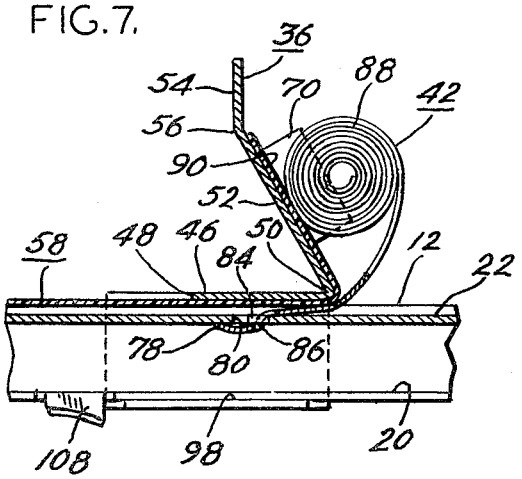
FIG. 7 is a section taken on the plane 7—7 of FIG. 5.

Referring to FIGS. 5, 6 and 7, the pusher comprises a unitary sheet metal member. A first section 46 of the sheet metal member is located above and adjacent the supporting surface provided by web 12 and extends in parallel relation to web 12. Section 46 acts as a foot and cooperates with the supporting surface to prevent tilting of the pusher. It has a front edge 48 and a straight rear edge 50. A second section 52 extends upwardly and forwardly from rear edge 50 of section 46, and a third section 54 extends upwardly from upper edge 56 of section 52. The rearmost bottle in the column of bottles is engaged by pusher section 54.

As shown in FIG. 5, the central portion of front edge 48 of pusher section 46 is provided with an arcuate recess so that a bottle, engaged by pusher section 54, does not rest on section 46. This configuration of section 46 is desirable for stability of the rearmost bottle in the column. Because of the curvature of the bottoms of soft drink bottles, edge 48 can be somewhat forward of pusher section 54, as shown in FIG. 5, without interfering with the rearmost bottle. With the arrangement shown in FIGS. 5 and 7, pusher section 46 has a sufficient longitudinal extent at its sides to provide a stable, non-binding support for the pusher, and yet does not interfere with the stability of the rearmost bottle.

Sheet 58 is an elongated flexible plastic sheet, preferably of polyester, and treated to have a self-coiling characteristic in accordance with the process described in U.S. Pat. No. 3,426,115, dated Feb. 4, 1969, the disclosure of which patent is incorporated by reference. As shown in FIG. 1, sheet 58 extends underneath the bottles, and between the bottles and web 12. The sheet is coiled at 60 within housing 34 at the front of the shelf, and extends rearwardly through slot 32. It extends underneath section 46 of the pusher, as shown in FIG. 7, and upwardly along the rear side of pusher section 52. Sheet 58 is secured to the rear side of the pusher by the engagement of openings 62 and 64 in the sheet with upwardly extending struck-out lances 66 and 68 respectively, as shown in FIGS. 5 and 6. Sloping pusher section 52 is also provided with a pair of rectangular projections 70 and 72 which extend in perpendicular relation to the rear face of the pusher and serve primarily as retaining elements for the drive spring. However, elements 70 and 72 also extend respectively through slots 74 and 76 of sheet 58 and thus serve as additional retaining elements for securing the sheet to the pusher.

The principal function of flexible sheet 58 is to eliminate direct contact between the bottoms of the bottles and the supporting surface of web 12 in order to eliminate the effects of varying frictional characteristics of soft drink bottles. In the operation of the device, sheet 58 slides on web 12, but the bottles remain in fixed relationship to sheet 58. The coefficient of friction between sheet 58 and the supporting surface of web 12 is less than the coefficient of friction between the underside of pusher section 46 and web 12. Since sheet 58 extends underneath section 48 of the pusher, it also promotes smooth operation of the pusher by eliminating direct contact between the underside of pusher section 46 and web 12.

End 78 of self-coiling spring 42 is secured to web 12 at a location preferably equal to or less than the width of a bottle from the front edge of web 12, as shown in FIG. 1.

Figure 8:
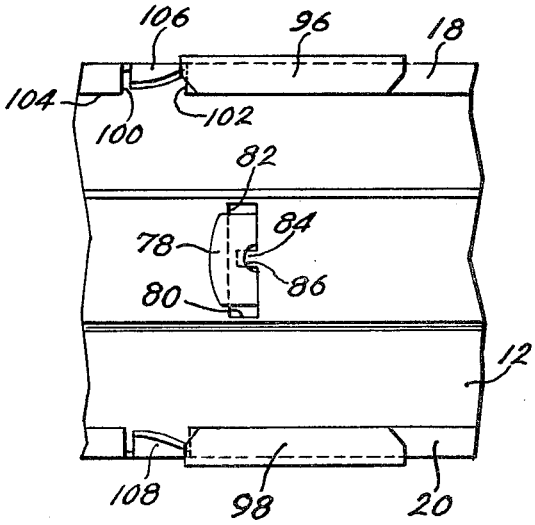
FIG. 8 is a fragmentary bottom plan view illustrating the manner in which the forward end of the self-coiling strip of spring material is secured to the rigid supporting surface.

As seen in FIGS. 7 and 8, the spring extends downwardly through a slot 80 in recess 22 of web 12, with its end 78 forward of front edge 82 of the slot a projection 84, extending forwardly from the rear edge of the slot extends through a hole 86 in the spring, thereby securing the spring in the slot. Since end 78 of the spring is positioned forward of front edge 82 of the slot, it engages the underside of the web, and is prevented from curling up and interfering with the movement of bottles on the track.

The spring is coiled at its opposite end at 88, and the coil is located between struck-out spring retainer elements 70 and 72, as best shown in FIGS. 5 and 6. Coil 88, as shown in FIG. 7, exerts a force against sloping pusher section 52 in a direction perpendicular to the rearward face of the pusher section. The coil does not come into direct contact with the sheet metal of the pusher. Rather, it bears against portion 90 (FIGS. 5 and 6) of flexible sheet 58. As coil 88 rotates in the operation of the device, portion 90 of the flexible sheet provides a bearing surface for coil 88, thereby promoting smooth operation of the pusher and eliminating the need for special low-friction coatings on the spring or on the rear surface of pusher section 52.

Referring to FIG. 6, the pusher section 46 has integral depending flanges extending downwardly from its outer edges and extending in close parallel relation to reinforcing flanges 14 and 16 of the track. Inwardly extending flanges 96 and 98 are provided at the lower ends of flanges 92 and 94 respectively. Flange 96 is located just below and parallel to track flange 18, and flange 98 is similarly located just below and parallel to track flange 20. The cooperation of the various flanges of the track and of the pusher constrains the pusher for movement along the track in a columnwise direction.

Figure 3:
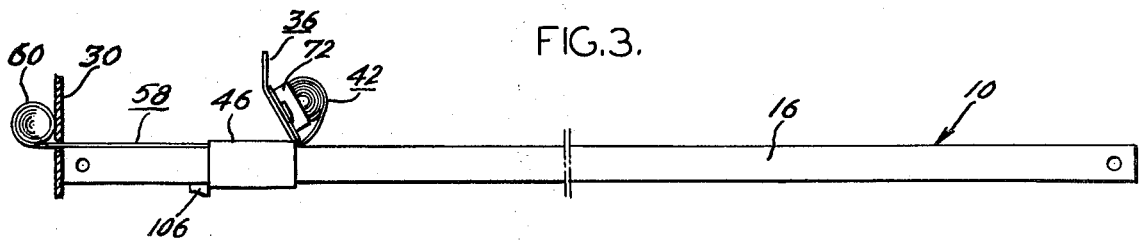
FIG. 3 is a side elevation thereof.
Figure 4:
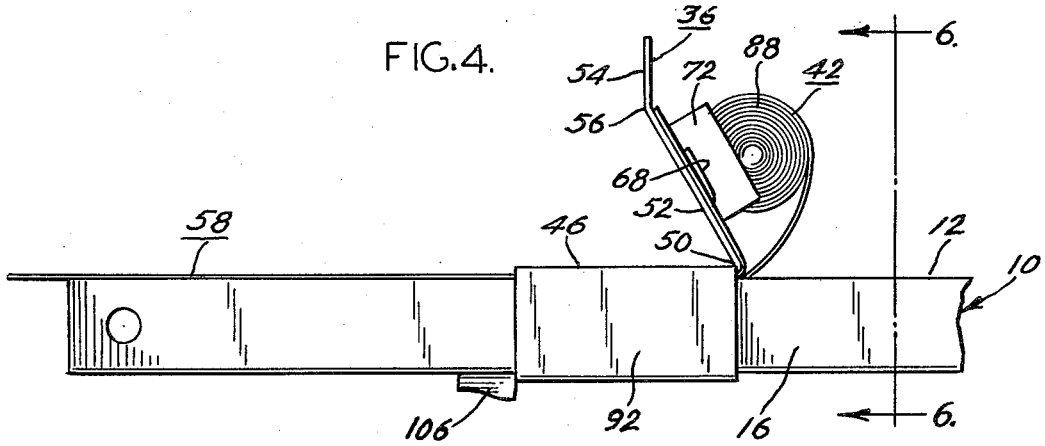
FIG. 4 is a fragmentary side elevation showing the details of the pusher means.

As shown in FIG. 8, inwardly extending flange 20 is provided with a pair of longitudinally spaced slots 100 and 102 extending outwardly from its inner edge 104 to provide a tab 106. A tab 108 is similarly provided on inwardly extending flange 18. Tabs 106 and 108 are directly opposite each other, and are located, as indicated in FIGS. 1 and 3, near the forward end of the track, and in positions such that they are not reached by the pusher until the pusher moves to within less than a bottle's width from the front edge of the track. The tabs are bent downwardly as shown in FIG. 7 and 8, and are engageable by inwardly extending flanges 96 and 98 of the pusher to prevent the pusher from being removed from the track.

In the assembly of the device, tabs 106 and 108 are initially unbent and parallel to flanges 20 and 18. The coil spring is secured in slot 80, and the pusher, with the flexible sheet attached to it, is slid on to the track. Coil 88 is positioned between coil retaining elements 70 and 72, and the pusher is then moved rearwardly until it clears tabs 106 and 108. The tabs are then bent downwardly, using pliers. The assembly is then complete and ready for installation in a shelf. The individual track units can be readily assembled in this manner, and shipped to customers for installation in their shelves.

The slope of pusher section 52 can be adjusted by bending the pusher at rear edge 50 of pusher section 46 (FIG. 7). Since the force, exerted by coil 88 on the rear face of pusher section 52 is perpendicular to that face at the location of engagement, and since the rearwardly facing surface is oblique with respect to the columnwise direction at that location, the force tending to urge the pusher forward in the columnwise direction is a vector component of the perpendicular force. Thus, the magnitude of the columnwise component can be adjusted by bending the pusher to adjust the angle between pusher sections 46 and 52. If conditions are such that the spring does not exert sufficient force against the column of bottles, the pusher can be bent so that section 52 is more nearly perpendicular to section 46. This will increase the magnitude of the columnwise component. On the other hand, if the columnwise force is too great, it can be reduced by bending pusher section 52 downwardly toward section 46. The pusher construction thus provides a simple and highly effective means for obtaining optimum performance from the pusher and spring assembly. At the same time, the forward slope of pusher section 52 allows a substantial part of spring coil 88 to be positioned above pusher section 46 rather than behind it. Thus, the pusher and spring coil assembly takes up relatively little longitudinal space, thereby allowing more space for bottles on the track.

Corner 50 (FIG. 7) of the pusher maintains the uncoiled portion of the spring within recess 22 so that it does not interfere with the movement of self-coiling sheet 58 or with the movement of the bottles resting on the sheet. The device relies upon spring 42 to effect columnwise movement of the pusher and the bottles, and spring 42 is in itself sufficient to effect movement of the pusher and bottles. Self-coiling sheet 58 exerts little, if any, force on the pusher. Coil 60 at the forward end of sheet 58 is merely for the purpose of take-up. The sheet, however, does cooperate with the spring coil in the sense that it eliminates the effects of friction variations between the bottles and the supporting surface of web 12, and thereby allows the spring coil to produce a smooth and reliable operation of the pusher regardless of the nature of the bottles in the column.

I claim:

1. Apparatus having the capability of supporting a plurality of upstanding bottles arranged in a generally horizontal column and automatically feeding the bottles in the column forward in a columnwise direction when the foremost bottle in the column is removed, comprising:

means providing a substantially rigid supporting surface for supporting a column of bottles;

means for guiding bottles supported by the supporting surface for movement in a columnwise direction parallel to said surface;

pusher means comprising a vertically extending member having a front side for engaging the rearmost bottle in the column, and a rear side;

guide means constraining the pusher means for movement in a columnwise direction;

means for stopping the movement of the column when the foremost bottle reaches a predetermined position relative to the supporting surface;

spring means urging said pusher means in a forward columnwise direction, said spring means comprising a self-coiling strip of spring material secured at one end to the supporting surface near the forward end thereof, extending rearwardly to a location behind said pusher means, and being coiled at said location, the coil being arranged to exert a forwardly directed force on the rear side of the pusher means, the force being sufficient, in any position within the range of movement of the pusher means, to move all of the bottles between the pusher means and said predetermined position in a forward columnwise direction until the foremost bottle reaches said predetermined position; and means comprising a length of flexible sheet material secured to the pusher means and extending forwardly therefrom along said supporting surface, said sheets being positioned underneath the bottles and between the bottles and the rigid supporting surface when bottles are present in the column, and serving substantially to eliminate variations in the coefficient of friction between the bottles and the supporting surface by preventing direct contact between the bottles and the supporting surface;

said length of flexible sheet material also extending over the rear side of the pusher means between said rear side and the coil of the spring means, whereby the flexible sheet material also serves as a bearing surface for said coil.

2. Apparatus according to claim 1 having means, projecting from the rear side of the pusher means, for restraining the coil against lateral movement, and in which the part of the flexible sheet which extends over the rear side of the pusher means is provided with slot means, and said projecting means extends through said slot means, said slot means and said projecting means serving to secure the flexible sheet to the pusher means.

3. Apparatus according to claim 1 in which the pusher means includes a foot extending forwardly from the lower end of said vertically extending member and parallel to and above the rigid supporting surface and in which the flexible sheet material extends underneath the foot and between the foot and the supporting surface, the coefficient of friction between the sheet and the supporting surface being less than the coefficient of friction between the foot and the supporting surface, said sheet also serving to reduce the friction between said foot and said supporting surface.

4. Apparatus having the capability of supporting a plurality of upstanding bottles arranged in a generally horizontal column and automatically feeding the bottles in the column forward in a columnwise direction when the foremost bottle in the column is removed, comprising:

means providing a substantially rigid supporting surface for supporting a column of bottles;

means for guiding bottles supported by the supporting surface for movement in a columnwise direction parallel to said surface;

pusher means for engaging the rearmost bottle in the column;

guide means constraining the pusher means for movement in a columnwise direction;

means for stopping the movement of the column when the foremost bottle reaches a predetermined position relative to the supporting surface; and spring means urging said pusher means in a forward columnwise direction said spring means exerting a sufficient force in any position within its range of movement to move all of the bottles between it and said predetermined position in a forward columnwise direction until the foremost bottle reaches said predetermined position;

in which the pusher means comprises a unitary sheet metal member having a first section located above and adjacent the supporting surface and extending in parallel relation thereto, said first section cooperating with the supporting surface to prevent tilting of the pusher and having a front edge and a rear edge, a second section extending upwardly and forwardly from said rear edge, said second section having an upper edge, and a third section extending upwardly from said upper edge, said third section being adapted to engage the rearmost bottle in the column; and in which said first section extends substantially forward of said third section and in which the central portion of the front edge of said first section is recessed to prevent a bottle engaged by the third section from resting on any part of the first section.

5. Apparatus having the capability of supporting a plurality of upstanding bottles arranged in a generally horizontal column and automatically feeding the bottles in the column forward in a columnwise direction when the foremost bottle in the column is removed, comprising:

means providing a substantially rigid supporting surface for supporting a column of bottles;

means for guiding bottles supported by the supporting surface for movement in a columnwise direction parallel to said surface;

pusher means for engaging the rearmost bottle in the column;

guide means constraining the pusher means for movement in a columnwise direction;

means for stopping the movement of the column when the foremost bottle reaches a predetermined position relative to the supporting surface; and spring means urging said pusher means in a forward columnwise direction, said spring means exerting a sufficient force in any position within its range of movement to move all of the bottles between it and said predetermined position in a forward columnwise direction until the foremost bottle reaches said predetermined position;

in which the spring means comprises a self-coiling strip of spring material secured at one end to the supporting surface near the forward end thereof, extending rearwardly to a location behind said pusher means, and being coiled at said location, the coil being arranged to exert a force having a forwardly directed component on the rear side of said pusher means; and in which said pusher means comprises means providing a rearwardly facing surface and said coil is in engagement with said rearwardly facing surface and exerts a force on said rearwardly facing surface perpendicular thereto at the location of said engagement, said rearwardly facing surface being oblique with respect to the columnwise direction at the location of said engagement, and in which the angle between said rearwardly facing surface and the columnwise direction, at the location of said engagement, is adjustable to vary the magnitude of said forwardly directed component of force.

6. Apparatus according to claim 5 in which said pusher means comprises a unitary sheet metal member having a first section located above and adjacent the supporting surface and extending in parallel relation thereto, and in which said means providing a rearwardly facing surface is integral with said first section and joined thereto along a straight line extending parallel to said supporting surface and transverse to the columnwise direction, and in which the angle between said rearwardly facing surface and the columnwise direction is adjustable by bending the pusher at said straight line.

7. Apparatus having the capability of supporting a plurality of upstanding bottles arranged in a generally horizontal column and automatically feeding the bottles in the column forward in a columnwise direction when the foremost bottle in the column is removed, comprising:

means providing a substantially rigid supporting surface for supporting a column of bottles;

means for guiding bottles supported by the supporting surface for movement in a columnwise direction parallel to said surface;

pusher means comprising a vertically extending member having a front side for engaging the rearmost bottle in the column and a rear side;

guide means constraining the pusher means for movement in a columnwise direction;

means for stopping the movement of the column when the foremost bottle reaches a predetermined position relative to the supporting surface;

spring means urging said pusher means in a forward columnwise direction, said spring means comprising a self-coiling strip of spring material secured at one end to the supporting surface near the forward end thereof, extending rearwardly to a location behind said pusher means and being coiled at said location, the coil being arranged to exert a forwardly directed force on the rear side of the pusher means, the force being sufficient, in any position within the range of movement of the pusher means, to move all of the bottles between the pusher means and said predetermined position in a forward columnwise direction until the foremost bottle reaches said predetermined position; and means comprising a length of flexible sheet material secured to the pusher means and extending forwardly therefrom along said supporting surface, said sheet being positioned underneath the bottles and between the bottles and the rigid supporting surface when bottles are present in the column, and serving substantially to eliminate variations in the coefficient of friction between the bottles and the supporting surface by preventing direct contact between the bottles and the supporting surface; said supporting surface having a recess extending rearwardly from the location at which the self-coiling strip is secured to the supporting surface at least to the rearmost location of the pusher means within its range of movement; and said pusher means including means for maintaining the portion of said self-coiling strip which extends between the pusher means and the location at which it is secured to the supporting surface within said recess;

whereby said portion of said self-coiling strip is located within said recess and underneath said flexible sheet so as not to interfere with the movement of the bottles in said column.

8. Apparatus according to claim 7 in which said self-coiling strip is arranged so that when the pusher means is viewed fron the side such that the front side thereof is to the left, the coil winds in the counterclockwise direction, and having a transverse slot in the recess of the supporting surface near the forward end thereof, the self-coiling strip extending through said slot with the forward end thereof located underneath the supporting surface and forward of said slot, the self-coiling strip having a through hole at the location of said slot, and the rear edge of said slot having a projection extending through said through hole thereby securing said strip in said slot.

9. Apparatus having the capability of supporting a plurality of upstanding bottles arranged in a generally horizontal column and automatically feeding the bottles in the column forward in a columnwise direction when the foremost bottle in the column is removed, comprising:

means providing a substantially rigid supporting surface for supporting a column of bottles;

means for guiding bottles supported by the supporting surface for movement in a columnwise direction parallel to said surface;

pusher means for engaging the rearmost bottle in the column;

means for stopping the movement of the column when the foremost bottle reaches a predetermined position relative to the supporting surface; and spring means urging said pusher means in a forward columnwise direction, said spring means exerting a sufficient force in any position within its range of movement to move all of the bottles between it and said predetermined position in a forward columnwise direction until the foremost bottle reaches said predetermined position;

in which said means providing a substantially rigid supporting surface is an elongated sheet metal element having an elongated web and a pair of reinforcing flanges located along its opposite long edges and extending downwardly therefrom, each reinforcing flange having an integral, inwardly extending flange at its lower edge;

in which said pusher means comprises a sheet metal member having a first section extending across said web in closely spaced parallel relation thereto, a pair of integral depending flanges extending downwardly from said first section, each in closely spaced parallel relation to one of said reinforcing flanges, and a pair of inwardly extending flanges, each being integral with one of the depending flanges, each of said inwardly extending flanges of the pusher means being arranged below and in closely spaced relation to an inwardly extending flange of the supporting surface providing means, whereby said flanges serve as guide means constraining the pusher means for movement in a columnwise direction; and in which each of the inwardly extending flanges of the supporting surface-providing means is provided with a pair of longitudinally spaced slots extending outwardly from its innermost edge to form a tab, the tabs being located opposite each other near the forward end of the supporting surface and being bent downwardly to positions such that they are engageable by the inwardly extending flanges of the pusher means to limit forward movement of the pusher means.

10. Apparatus having the capability of supporting a plurality of upstanding bottles arranged in a generally horizontal column and automatically feeding the bottles in the column forward in a columnwise direction when the foremost bottle in the column is removed, comprising:

means providing a substantially rigid supporting surface for supporting a column of bottles; means for guiding bottles supported by the supporting surface for movement in a columnwise direction parallel to said surface;

pusher means for engaging the rearmost bottle in the column;

guide means constraining the pusher means for movement in a columnwise direction;

means for stopping the movement of the column when the foremost bottle reaches a predetermined position relative to the supporting surface;

spring means urging said pusher means in a forward columnwise direction, said spring means exerting a sufficient force in any position within its range of movement to move all of the bottles between it and said predetermined position in a forward columnwise direction until the foremost bottle reaches said predetermined position;

means comprising a length of flexible, self-coiling, sheet material secured at one end to the pusher means, extending forwardly therefrom along said supporting surface and being coiled at its opposite end, said sheet being positioned underneath the bottle and between the bottles and the rigid supporting surface when bottles are present in the column, and serving substantially to eliminate variations in the coefficient of friction between the bottles and the supporting surface by preventing direct contact between the bottles and the supporting surface; and means located adjacent the forward end of the supporting surface for retaining the coiled end of said self-coiling sheet at a substantially fixed location while allowing said sheet to coil as said pusher means moves forward.

* * * * *